US009341452B1

(12) United States Patent
Baber

(10) Patent No.: US 9,341,452 B1
(45) Date of Patent: May 17, 2016

(54) GUN CARTRIDGE

(71) Applicant: Jerry Baber, Piney Flats, TN (US)

(72) Inventor: Jerry Baber, Piney Flats, TN (US)

( * ) Notice: Subject to any disclaimer, the term of this patent is extended or adjusted under 35 U.S.C. 154(b) by 0 days.

(21) Appl. No.: 14/121,335

(22) Filed: Aug. 20, 2014

Related U.S. Application Data

(60) Provisional application No. 61/959,332, filed on Aug. 21, 2013.

(51) Int. Cl.
*F42B 5/03* (2006.01)
*F42B 7/04* (2006.01)
*F42B 7/06* (2006.01)

(52) U.S. Cl.
CPC . *F42B 7/046* (2013.01); *F42B 5/03* (2013.01); *F42B 7/06* (2013.01)

(58) Field of Classification Search
CPC ..... F42B 5/02; F42B 5/03; F42B 5/26; F42B 5/30; F42B 7/00; F42B 7/02; F42B 7/04; F42B 7/06; F42B 8/12; F42B 10/32; F42B 10/34; F42B 10/38; F42B 12/76; F42B 14/06; F42B 14/065
USPC ..... 102/438, 439, 444, 448, 449, 454, 462, 102/463, 464, 465, 466, 467, 201, 502, 503, 102/506, 520, 529
See application file for complete search history.

(56) References Cited

U.S. PATENT DOCUMENTS

| | | | | |
|---|---|---|---|---|
| 2,766,692 | A * | 10/1956 | Mynes | 102/449 |
| 3,673,965 | A * | 7/1972 | Herter | 102/462 |
| H238 | H * | 3/1987 | Adams | 102/493 |
| 4,805,535 | A * | 2/1989 | Marcon | 102/503 |
| 4,913,054 | A * | 4/1990 | Petersen | 102/439 |
| 5,834,682 | A * | 11/1998 | Warren | 102/439 |
| 2005/0039627 | A1 * | 2/2005 | Zanoletti | 102/449 |
| 2005/0056184 | A1 * | 3/2005 | Dunnam et al. | 102/458 |
| 2013/0228090 | A1 * | 9/2013 | Billings | 102/457 |

FOREIGN PATENT DOCUMENTS

| | | | | |
|---|---|---|---|---|
| GB | 2032070 A | * | 4/1980 | F42B 7/10 |

* cited by examiner

*Primary Examiner* — Bret Hayes

(57) ABSTRACT

A gun cartridge such as a shotgun shell wherein the pellet load is contained in a projectile consisting of a frangible casing and a MV element wherein the MV element imparts long range travel and accuracy to the projectile and wherein the frangible casing readily breaks apart on impact with the target and allows the pellets to disperse in typical array.

7 Claims, 1 Drawing Sheet

GUN CARTRIDGE

BACKGROUND

This invention concerns a gun cartridge having a highly unique long range construction which allows the projectile load, e.g., a shotgun shell pellet type charge, to be propelled an extraordinary distance with markedly enhanced accuracy wherein the charge is beginning its dispersile not at its exit from the gun barrel but at the impact (target) site wherein the target damage is the result of the full impact of the high momentum projectile charge in minimally dispersed form and its subsequent dispersile.

PRIOR ART

Heretofore, gun cartridges which employ a dispersible type load as in shotgun shells have provided limited range distance accuracy due to the natural rapid dispersal of pellets by contact with air molecules beginning at their very exit form the barrel. The present cartridge is constructed such that pellet dispersal is prevented until the load reaches the target.

SUMMARY OF THE INVENTION

The present invention in one preferred embodiment is summarized as a gun cartridge capable of delivering a pelletized charge to a target with greatly improved accuracy and destructive force at greatly increased long range distances, wherein the present cartridge comprises a rifle cartridge shell or a shotgun shell having an explosive section and a load section, a projectile element in the load section and having a tubular projectile casing of frangible plastic material, most preferably polycarbonate, a nose cone covering a distal end of the casing to provide a load chamber, a MV plug fitted into a proximal end of the casing, a pelletized load within the load chamber, and the outside surface of the casing being provided with rifling ridges, wherein the projectile casing readily breaks apart on impacting a force resistive (non-atmospheric) target and allows dispersal of the pellets, and wherein the weighted MV (momentum) plug greatly increases the distance and accuracy which the housed pellet charge will travel when fired.

BRIEF DESCRIPTION OF THE DRAWINGS

The invention will be understood further from the drawings herein wherein the figures are not drawn to scale or in consistent proportions and dimensions and are intended to illustrate the preferred structure and functions of the various basic and exemplary components of the present invention, and wherein.

DETAILED DESCRIPTION OF THE DRAWINGS

Figure 1:
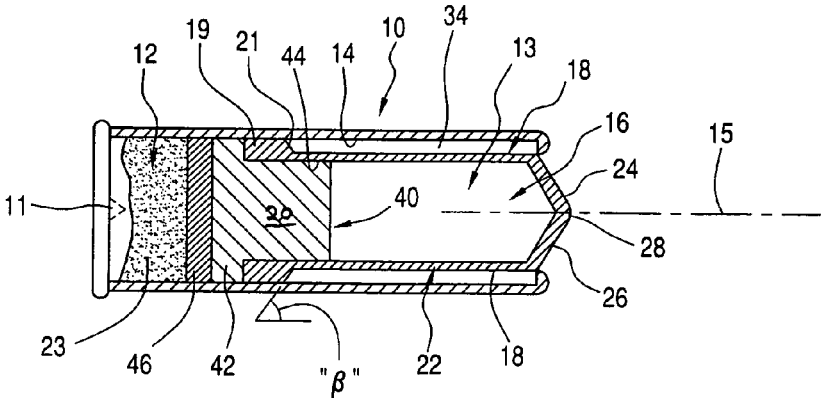
FIG. 1 is a longitudinal cross-sectional enlarged view of a shotgun shell modified by the present long range projectile element construction.
Figure 2:
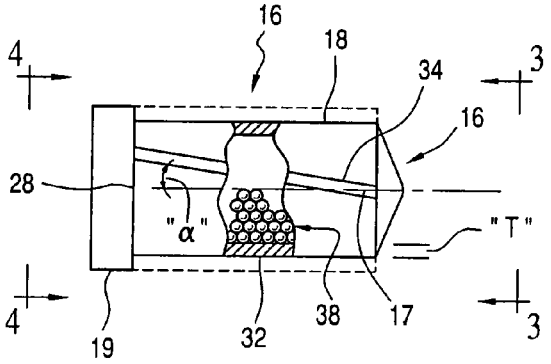
FIG. 2 is a side view, with portions broken away for clarity, of the isolated projectile element of FIG. 1 and showing only an exemplary one of preferred twelve rifling ridges.
Figure 4:
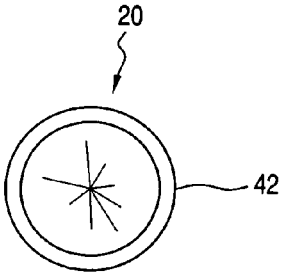
FIG. 4 is a rear end view of the projectile element of FIG. 2 taken along line 4-4 in FIG. 2.
Figure 3:
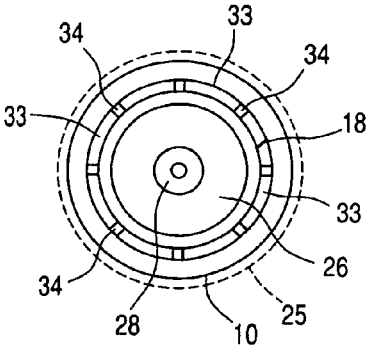
FIG. 3 is a front end view of the projectile element casing of FIG. 2 taken along line 3-3 in FIG. 2 and showing the projectile element at its exit point of a gun barrel shown in dotted line.
Figure 5:
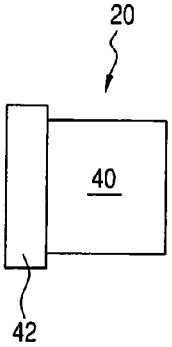
FIG. 5 is an isolated side view of the momentum (MV) section of the projectile element of FIG. 1.
Figure 6:
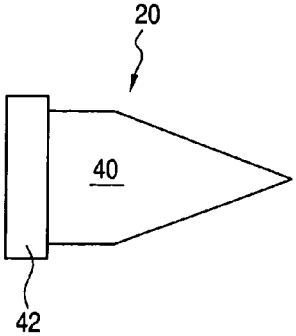
FIG. 6 is an isolated side view of a shape variation of the MV section of the projectile element.

Referring to the drawings, and particularly in regard to a preferred embodiment of the present invention, FIG. 1 shows in cross-section the basic portions of a conventional shotgun 25 shell 10 having a metal jacketed explosive section 12 with primer 11 and powder 23 and further a pellet load section 13 of composite paper or plastic composition, wherein the shell bore 14 contains the present projectile element generally designated 16. It is noted that shell 10 may also comprise a full metal jacket in the nature of a rifle cartridge. The projectile element 16 comprises a tubular casing 18 a longitudinal axis 15, having a MV (momentum) section 20 and a load section 22 and has one end (distal) 24 covered by a nose cone 26 and its other end 28 frictionally receiving a plug portion 40 of MV section 20. The casing 18 is of strong but frangible material, preferably of plastic such as non-plasticized polyester, butyrate, acrylic, or the like but most preferably polycarbonate and has a wall 32 thickness "T" of from about 1/32 in. to about 3/16 in. and which is grooved 33 to provide rifling ridges 34 of a height of from about 1/16 in. to about 1/8 in. but leaving an adequate wall thickness "T" to prevent inopportune breakage of the casing. The number of rifling ridges can be varied but from, e.g., 8-16 are preferred while 10-14 are most preferred. These ridges are equally circumferentially spaced around the casing and angled slightly, e.g., from about 2 to about 10 degrees "a" from the longitudinally, axially extending surface lines 17 one of which is shown in FIG. 2, and as shown by ridge 34 in FIG. 2.

The proximal end of casing 18 preferably is not grooved such as to provide a sturdy base rim 19 on 18 for receiving impact forces from MV section 20 upon firing and for preventing air pressure in the groove 33 from causing separation of section 20 from casing 18. Further, grooves 33 are angled "β", e.g., 20°-60° as shown by surfaces 21 and assist in reducing direct air pressure forces against rim 19, which forces otherwise could retard the projectile flight. The nose cone 26 is shaped such that impact of the target on the nose 28 of the cone will indent the cone and pressurize the load section 13 to assist in explosion of the casing and dispersion of the load components 38 such as metal pellets, BB's, metal shards, etc.

The MV section 20 is preferably of aluminum but can be of steel, copper, brass or other metals or materials which in combination with the load will distribute the force of the powder explosion uniformly around the casing 18 and prevent premature breaking up of the casing as well as imparting momentum to the projectile to carry it on a predetermined trajectory and imparting forward momentum to the load pellet after impacting the target. This section 20 is formed with a plug portion 40 and a head portion 42 wherein the plug portion is hand or machine press fitted into the neck portion 44 of casing 18. Typically, wadding such as 46 is provided as needed.

The invention has been described in detail with particular reference to preferred embodiments thereof, but it will be understood that variations and modifications will be effected within the spirit and scope of the invention.

I claim:

1. A gun cartridge comprising a tubular first casing formed to provide an elongated tubular first cavity having a proximal firing end section and a distal pellet load end section, said firing end section containing a primer and explosive material, a projectile structure is positioned in said distal load end section and comprises a frangible shatterable tubular second casing of a polymeric material providing an elongated tubular second cavity having a closed distal load end portion, and an open proximal neck end portion, wherein the wall thickness of said load end portion ranges from 1/32 in. to 3/16 in., a momentum (MV) element is mounted in said neck end portion, and a pellet load is contained in said distal load end portion of said second cavity, wherein said MV element comprises a metallic body having a plug portion dimensioned for a close sliding fit into said neck end portion of said second cavity, and further having a circular head portion providing an annular shoulder for distributing firing forces evenly around said tubular second casing, and wherein a plurality of rifling ridges and adjacent grooves are provided on the exterior wall surface of said load end portion of said tubular second casing, which ridges and grooves extend slightly laterally angularly and generally longitudinally of said second casing.

2. The cartridge of claim 1 comprising a shotgun shell wherein said firing end section is encased by a metal tubular wall and said load end section is encased in a non-metallic material.

3. The cartridge of claim 1 wherein said grooves define said ridges and wherein each groove terminates at a proximal end portion of each groove at a radially outwardly directed surface which is angled radially upwardly and outwardly in a distal to proximal direction at an angle to a longitudinal axis of said second casing from about 20° to about 80°.

4. The cartridge of claim 1 wherein said polymeric material is polycarbonate.

5. The cartridge of claim 1 wherein said second casing is comprised of a polymeric material selected from the group consisting essentially of frangible polyester, poly-butyrate, poly-acrylic and poly-carbonate.

6. The cartridge of claim 5 wherein said neck end portion of said second casing terminates in a circular planar first surface, and wherein said MV element has a circular planar second surface abutting said first surface whereby firing forces directed against said MV element will be transmitted evenly to said first surface and prevent breaking of said second casing upon firing said cartridge.

7. The cartridge of claim 6 wherein a circular axially oriented shoulder portion of said MV element is provided on said second surface and projects axially through said open end portion of said neck end portion and lies contiguously to an inner wall surface of said open end portion.

* * * * *